US006870138B2

(12) United States Patent
Pastore

(10) Patent No.: US 6,870,138 B2
(45) Date of Patent: Mar. 22, 2005

(54) ELECTRIC COOKING HOB AND METHOD FOR DETERMINING THE LOCATION OF COOKING UTENSILS ON IT

(75) Inventor: Cristiano Pastore, Borgomanero (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/758,489

(22) Filed: Jan. 15, 2004

(65) Prior Publication Data

US 2004/0144769 A1 Jul. 29, 2004

(30) Foreign Application Priority Data

Jan. 20, 2003 (EP) ..... 03001221

(51) Int. Cl.[7] ..... H05B 3/68

(52) U.S. Cl. ..... 219/447.1; 219/518; 219/446.1; 219/448.11; 219/468.13; 219/483

(58) Field of Search ..... 219/447.1, 518, 219/446.1, 448.11, 448.12, 468.13, 460.1, 483, 490, 509

(56) References Cited

U.S. PATENT DOCUMENTS 3,215,817 A 11/1965 Peek ..... 219/446

6,184,501 B1 * 2/2001 Zapf ..... 219/447.1

FOREIGN PATENT DOCUMENTS

| | | | |
|---|---|---|---|
| EP | 1206164 | * 10/2001 | |
| EP | 1206164 | 5/2002 | ..... H05B/3/74 |
| IT | MI200A000926 | 4/2000 | |
| WO | WO 97-12298 | 4/1997 | |

* cited by examiner

*Primary Examiner*—Shawntina Fuqua
(74) *Attorney, Agent, or Firm*—Robert O. Rice; John F. Colligan; Stephen Krefmen

(57) ABSTRACT

An electric cooking hob having a plurality of heating elements distributed in matrix formation below a heat-resistant surface on which one or more cooking utensils can be located in random manner. The cooking hob can determine the location, form and dimensions of one or more cooking utensils positioned on the cooking hob. The cooking hob uses a signal source to determine which heating elements lie under the cooking utensil. The cooking hob can heat the elements lying below the cooking utensil by a power source. Each heating element being able to be energized with a polarity opposite to the polarity of the current used to perform the determination, so that the power source and the signal source can be applied at the same time to different heating elements.

7 Claims, 4 Drawing Sheets

ELECTRIC COOKING HOB AND METHOD FOR DETERMINING THE LOCATION OF COOKING UTENSILS ON IT

BACKGROUND OF THE INVENTION

1. Field of the Invention

The present invention relates to an electric cooking hob and to a method for determining the location of cooking utensils on the cooking hob. More particularly, the present invention relates to a cooking hob having a plurality of thermal cells distributed in matrix formation below a heat-resistant surface on which cooking utensils can be located in random manner.

Cooking hobs having devices for sensing pot position (and for simultaneously energizing the related heating elements below the pot) are known in the art of cooking appliances, such class of cooktops being called "High versatility cooktops". These cooktops allow the user to place a cooking utensil in any part of the cooking surface, without being compelled to position the utensils in predetermined fixed positions. High versatility cooktops are usually realized by dividing the cooking area into small heating elements usually arranged into hexagonal or orthogonal grids.

Despite having been disclosed long time ago, these cooktops never reached the market due to a huge complexity of the proposed technical implementation. It is an object of the present invention to disclose some method to reach an industrially feasible implementation, by solving a number of issues present in the technical solutions according to prior art.

2. Description of the Related Art

In order to be convenient, such high versatility cooktops should include some systems able to deliver heat only below the pot location, in order to energize only the part of the cooktop actually covered by the cooking utensil(s). Such systems may rely on mechanical switches, thermal load identification or optical techniques. All of these techniques are, in practice, hardly feasible because all of them make use of a large number of discrete sensors, each one having to work at extremely high temperatures usually reached inside the heaters (up to 1000° C.). The technical solution disclosed in EP-A-1206164 in the name of the present applicant describes a technique that addresses the latter problem by using the heating elements themselves as cooking utensil sensors. Such method works by injecting into each one of the heating cell an alternating current, radio-frequency (RF-AC) signal and detecting the induced signal in one or more conductive loops placed between the cooking utensil and the heating cell, such induced signal being substantially changed by the pot presence. This known solution also discloses one possible electrical method to apply both the power current needed to heat-up the elements and the RF-AC signal needed to sense the presence of pots. The suggested method, despite being meritorious, has the disadvantage that the pan detection and power currents cannot be applied exactly at the same time but they need to be non-overlapping in time. This means that the action of detecting the presence of cooking utensils on a given thermal cell matrix (each thermal cell being a single small heating electrical resistor) requires the complete switch off of the power for a time that, in practice, cannot be lower than some tenth of milliseconds. The temporary switch off of the load can rise problems in the compliance with the "flicker" norms imposed in most industrialized countries.

It is therefore an object of the present invention to solve the problem of the simultaneous application of both the power current and RF-AC current to the heating cells of a matrix organized high versatility cooktop.

SUMMARY OF THE INVENTION

One embodiment of the invention is a cooking hob having a plurality of thermal cells distributed in matrix formation below a heat-resistant surface on which one or more cooking utensils can be located in a random manner. The cooking hob comprising means for determining the locations, form and dimensions of the one or more cooking utensils positioned on the cooking hob. The means including a signaled source, means for processing a signal from the signal source individually through the plurality of thermal cells to determine which thermal cells lie under the one or more cooking utensils. The cooking hob also comprises means for enabling those of the thermal cells lying below the one or more cooking utensils. The thermal cells being able to be energized with a polarity opposite to the polarity of the current used to perform the determination, so that the power source and the signal source can be applied at the same time to different thermal cells.

Another embodiment of the invention is a method for determining the location of cooking utensils on a cooking hob comprising a plurality of thermal cells distributed in matrix formation below a heat resistant surface on which the cooking utensil can be located in random manner. The method comprising the steps of determining the location, and dimensions of the cooking utensil, enabling the thermal cells lying below the utensil to be energized by a power source, the thermal cell being individually used also for the determination, and applying a power current source and a signal source at the same time to different thermal cells.

BRIEF DESCRIPTION OF THE DRAWINGS

The present invention offers the possibility to overcome the limitations of the solution disclosed in EP-A-1206164, by allowing the simultaneous injection of power in one or more cells while allowing the simultaneous injection of the radio frequency stimulus into one or more other cells. The basic concept of the invention is to give opposite polarities to the power (heating) current respect to the AC+DC current used to perform the pot detection according to the method disclosed in EP-A-1206164, by using one of the diode structures described in the following preferred embodiments, given hereinafter by way of non-limiting example and illustrated in the accompanying drawings, in which.

DETAILED DESCRIPTION

Figure 1:
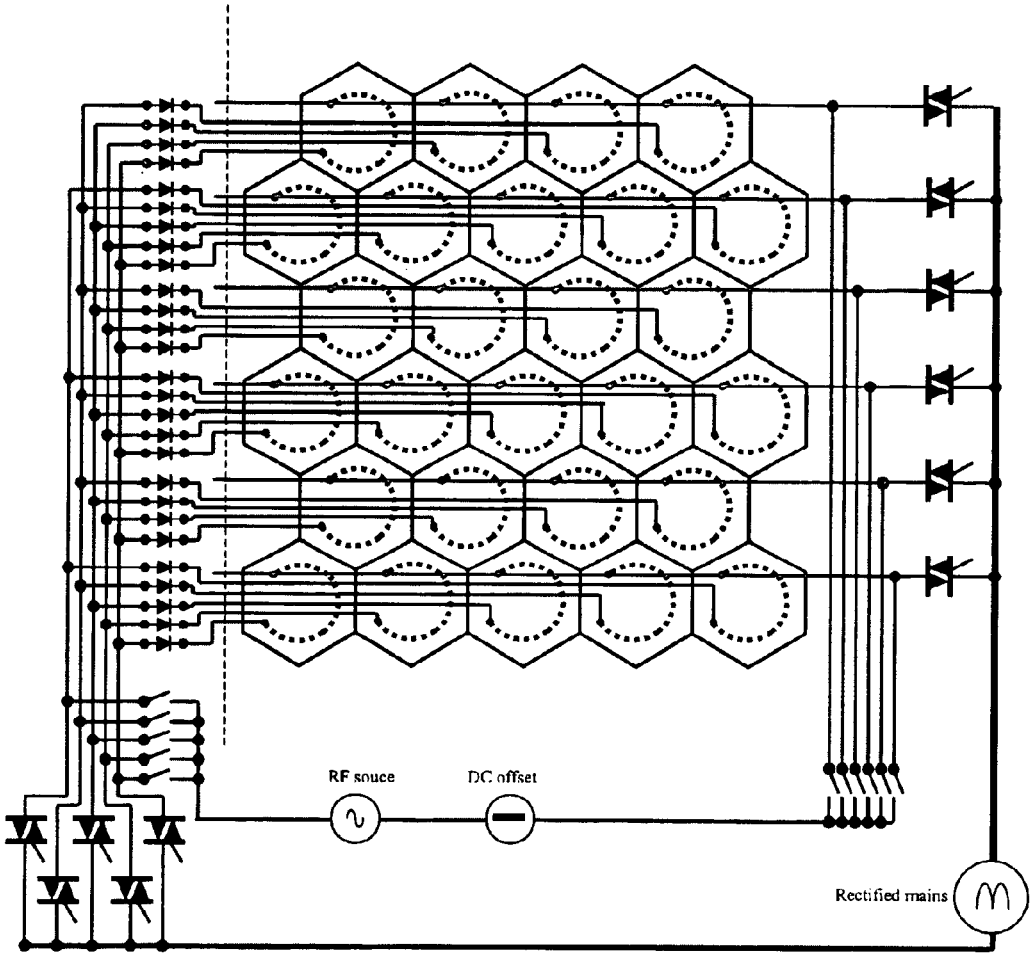
Figure 1 (Prior Art)
FIG. 1 is a schematic view of a device according to prior art, with its electrical-electronic circuitry.

The circuit technology disclosed by EP-A-1206164 and shown in FIG. 1 (prior art) can be defined as an uni-polar non interlaced technology.

Figure 2:
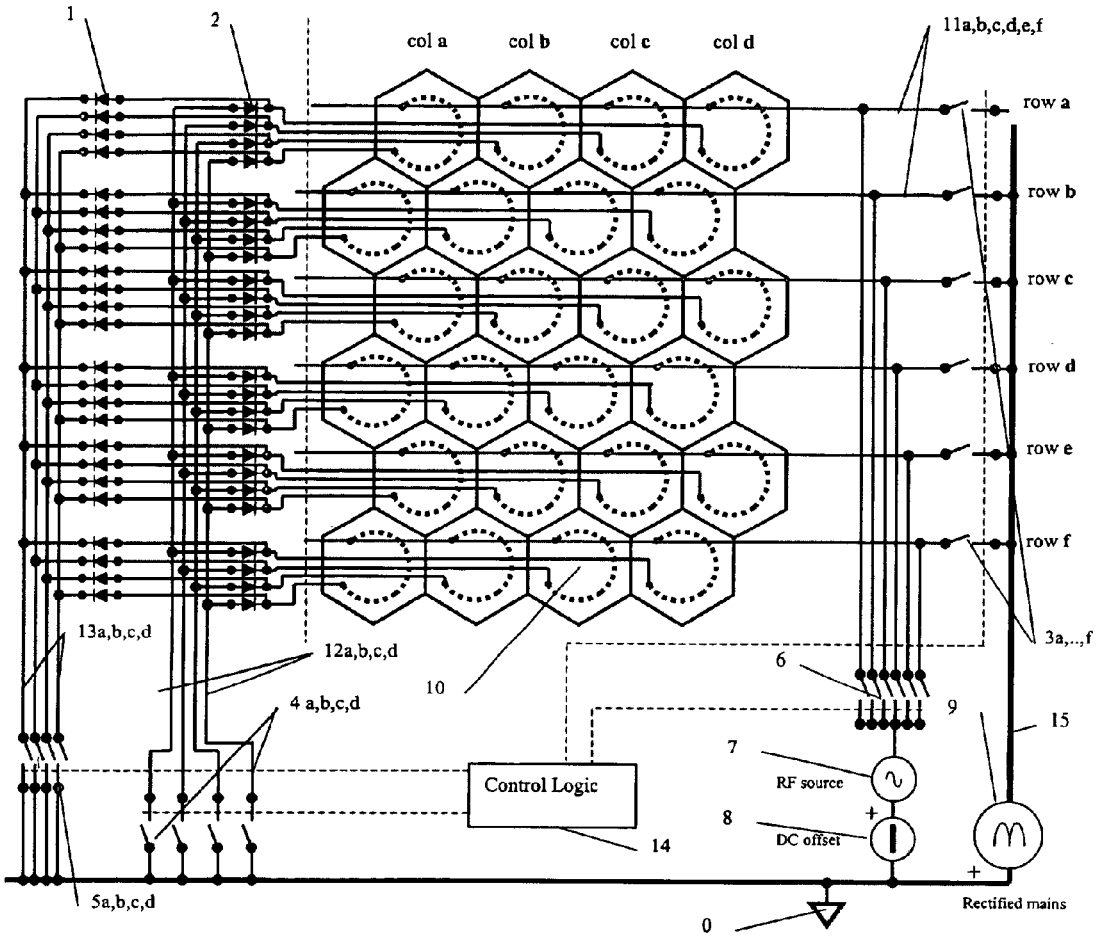
FIG. 2 is a schematic view of a device according to a first embodiment of the present invention, in which the circuit presents an uni-polar interlaced topology.

With reference to FIG. 2, it is shown a first embodiment of the invention in which heating cells 10 are physically arranged in a honeycomb structure on the cooktop, but they are actually electrically connected in a duplicated-rows/single-columns matrix (having in this example 6 rows and 4 columns for sake of simplicity, the concept being applicable to any other number of rows and columns). Each cell 10 lying on a "row a" is connected by one of its leads to an associated row bar 11*a*, the same standing for all the other rows (11*b,c,d,e,f*). The other lead of each of the cells 10 is connected to one small power diode 1 by anode and to a hi-power diode 2 by cathode. All the small power diodes 1 insisting on cells lying on "column a" have the cathodes connected together by means of a respective signal column bar 13*a*, the same standing for all the other signal column bars (13*b,c,d*); similarly all the high power diodes 2 insisting on cells lying on "column a" have the anodes connected all together by means of a power column bar 12*a*, the same standing for all the other power column bars (12*b,c,d*). Each one of the power column bars can be electrically brought to the reference voltage (0) by closing the relative solid state switch 4, said reference voltage being the positive lead of a generic uni-polar power source here represented, as a preferred solution, by a rectified mains 9. Each one of the row bars 11 can be electrically brought to a voltage negative compared to the reference voltage (0), by closing the associated solid state switch 3.

By using this arrangement, the applicant has obtained a double interlaced matrix of elements organized in row/columns in which it is possible to energize one or more heating elements or cells 10 and, at the same time, inject a radio frequency stimulus into one or more other cells, provided that cells to be powered lies at the intersection of rows and columns different than those of the cells to be injected with RF stimulus.

The method of operating the interlaced double matrix in order to obtain the aforementioned simultaneous application of hi-power for heating and RF stimulus for pan detection, is described as follows. Each heating element 10 can be energized by closing the solid state power switch 4 of the relative power column bar 12 thus connecting the bar itself to the reference voltage (0) and, at the same time, closing the solid state switch 3 of the relative row bar 11, thus connecting the power row itself to a voltage lower than the reference voltage (0). At the same time, another cell 10 can be RF injected by closing the solid state signal switch 5 of the relative signal column bar 13 thus connecting the bar itself to the reference voltage (0) and, at the same time, closing the signal solid state signal switch 3 of the relative row bar 11, thus connecting the power row itself to a voltage higher than the reference voltage (0). The correct sequencing of the static switches 3, 4, and 5, as well as the switches 6, is handled by a digital control logic 14 (for instance a microprocessor). It is obviously evident that one can obtain a substantially equivalent technical solution by reversing the polarity of all the diodes 1 and 2, the rectified mains source 9 and the DC offset 8.

Another equivalent solution is to exchange the role of the rows and the columns (in that case the two interlaced sub-matrices will share the column bars instead of the row bars).

In the preferred technical solution, the static power switches 4 are silicon controlled rectifiers (SCR) or insulated gate bipolar transistors (IGBT), the power static switches 3 are TRIACS, the signal static switches 5 are MOSFETs or BJTs and the signal static switches 6 are opto-triacs.

Figure 3:
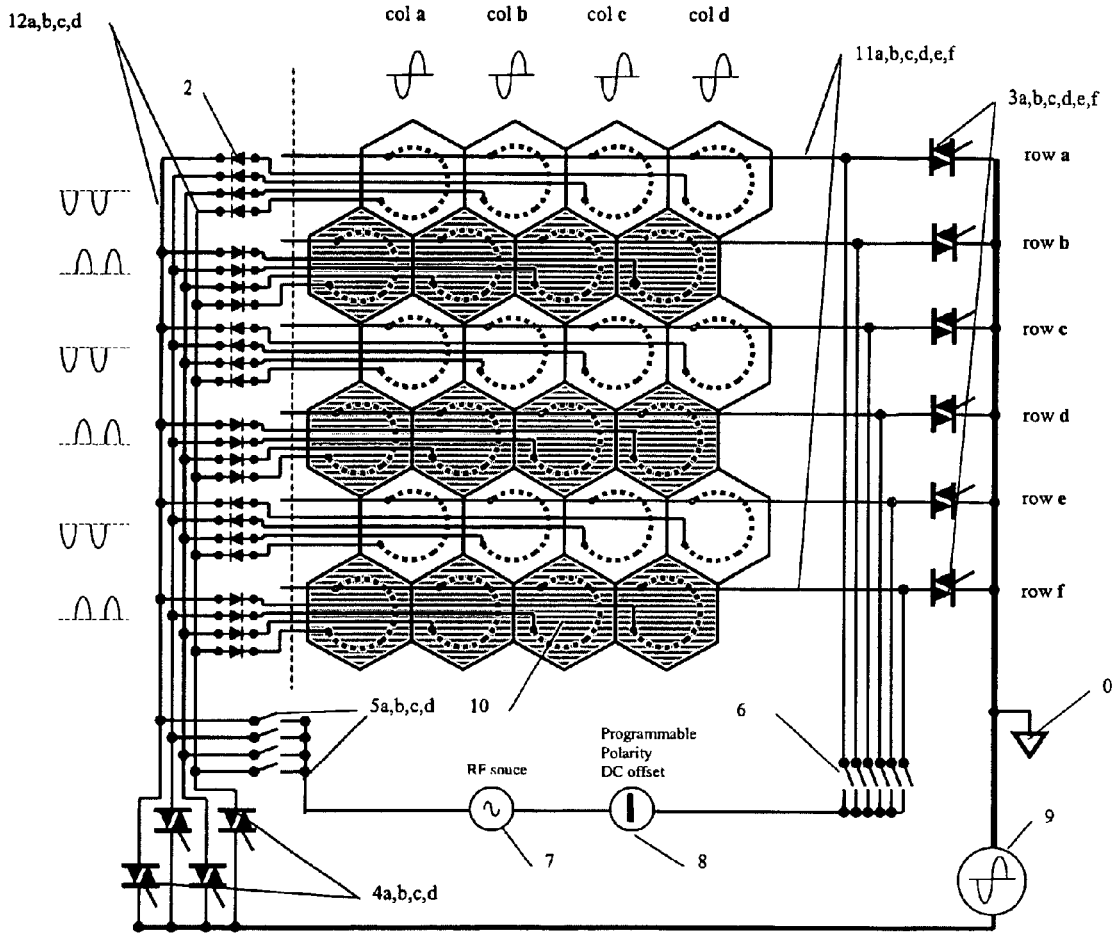
FIG. 3 is a schematic view of a device according to a second embodiment of the present invention, with a bi-polar circuit topology interlaced by rows.

FIG. 3 shows a second embodiment of the invention in which the equal or corresponding parts are indicated by the same reference numerals of FIG. 2. In FIG. 3 the heating cells 10 are electrically connected in a row/column matrix in which the heating cells 10 connected to odd rows (like row a, row c, etc.) are connected to the diodes 2 at the anode and the heating cells 10 connected to even rows (like row b, row d, etc.) are connected to the diodes 2 at the cathode. The leads of the diodes 2 not connected to the heating cells 10, are connected to the column bars 12, and each of those bars can be brought to the voltage of first of the two leads of a power a.c. source by closing the relative solid state switch 3, realized by a TRIAC in a preferred solution.

Each of the rows bars 11 can be brought at the voltage of the second of the two leads of a power a.c. source by closing the relative solid state switch 4. As a man skill in the art can easily understand, a circuit arranged as in FIG. 3 allows the energisation of cells 10 lying on odd rows (as 3*a*, 3*c* etc.) only when the a.c. power source 9 is negative on the column side and positive on the row side, being exactly the opposite for the cells lying on even rows (as 3*b*, 3*d* etc.). The apparent disadvantage of being able to energize each cell 10 only on half of the a.c. semi-waves, opens the possibility to inject the pan detection RF stimulus during the other half, just taking advantage of the reversed polarity of ac power source as one can understand by the following example. Assuming that we want to deliver power into the heating cell connected at "row a" and at "column c", we will close the solid state switch (3*a*) and (4*c*); this will be possible only at the times in which the row voltage is higher than the column voltage. At the same time, in order to inject RF stimulus into the heating cell connected at "row b" and at "column d", we will have to close the solid state switch 3*b* and 4*d*; at the same time, the programmable polarity d.c. offset 8 will need to be set to have the current flowing into the diode 2 in series with the cell to be RF injected.

In other words, the configuration depicted in FIG. 3 uses the same technique of reverse polarization between the power source and the RF stimulus used in the configuration of FIG. 2 (that is the key for the simultaneous injection of power and RF), but using a single row-column matrix realizing two virtual sub-matrices by means of the different polarization of the diodes 2.

Also in this second preferred embodiment, a control logic, not reported in FIG. 3, will take care of the switching of solid state switches 3 and 4.

Figure 4:
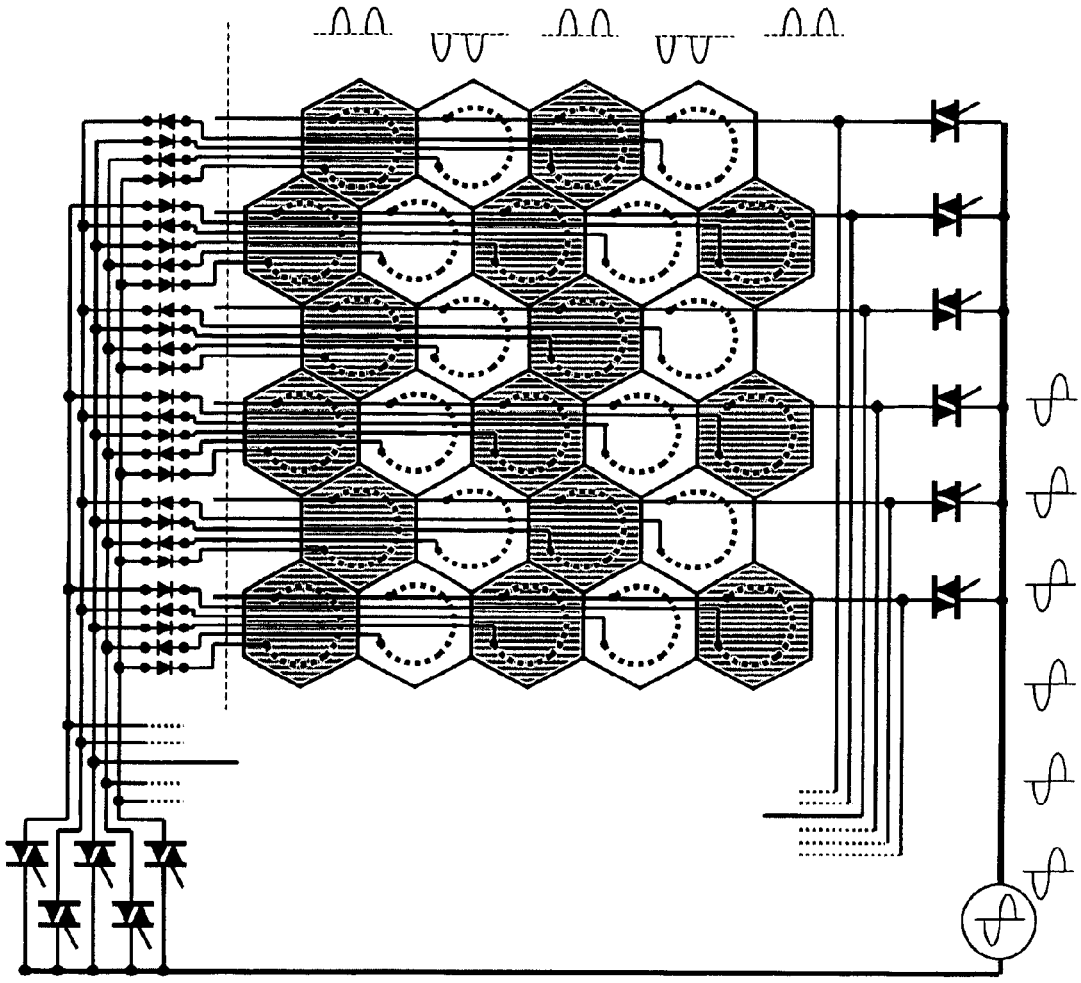
FIG. 4 shows a circuit similar to the one of FIG. 3, with a bi-polar topology interlaced by columns.

FIG. 4 shows an embodiment similar to the one shown in FIG. 3, in which the circuit is interlaced by columns rather than by rows.

I claim:

1. A cooking hob having a plurality of thermal cells distributed in matrix formation below a heat-resistant surface on which one or more cooking utensils can be located in random manner comprising means for determining the location, form and dimensions of the one or more cooking utensils positioned on the cooking hob including a signal source, means for processing a signal from the signal source individually through the plurality of thermal cells to determine which thermal cells lie under the one or more cooking utensils; and means for enabling those of the thermal cells lying below the one or more cooking utensils to be energized by a power source, wherein each thermal cell is able to be energized with a polarity opposite to the polarity of the current used to perform said determination, so that the power source and the signal source can be applied at the same time to different thermal cells.

2. The cooking hob according to claim 1, wherein the signal source is a radio frequency source with a direct current offset.

3. The cooking hob according to claim 1, wherein the cooking hob is duplicated rows/single-columns matrix in which each thermal cell lying on a row is connected by a first lead thereof to a respective row bar, the second lead of each thermal cell being connected to a first diode by anode and to a second diode by cathode, all first diodes connected to thermal cells lying on a column having the cathodes connected all together by means of a respective first column bar, all the second diodes connected to thermal cells lying on a column having anodes connected all together by means of a respective second column bar, each one of the second column bars being electrically connectable to a reference voltage by closing solid state first switches, each one of the row bars being electrically brought connectable to a voltage negative compared to the reference voltage by closing second solid state switches, each of the row bars not connected through the first switches to a voltage negative compared to the reference being connectable to a voltage positive to the reference through third solid state switches, each of the columns bars being connectable to the reference voltage through fourth solid state switches.

4. The cooking hob according to claim 1, wherein the thermal cells of the row/column matrix which are connected to odd rows are connected to diodes at the anode, the thermal cells which are connected to even rows being connected to diodes at the cathode, the leads of diodes not connected to thermal cells being connected to column bars, each of the column bars being able to be brought at the voltage of a first of the two leads of a power a.c. source by closing a relative first solid state switch, each of the row bars being able to be brought at the voltage of the second of two leads of a power a.c. source by closing a relative second solid state switch, each of the row bars being also able to be connected to one lead of a d.c. offset radiofrequency source by means of third solid state switches, each of the column bars being also able to be connected to the other lead of the d.c. offset radiofrequency source by means of fourth solid state switches.

5. A method for determining the location of cooking utensils on a cooking hob comprising a plurality of thermal cells distributed in matrix formation below a heat-resistant surface on which the cooking utensil can be located in random manner, the method comprising the steps of: determining the location, form and dimensions of the cooking utensil; enabling the thermal cells lying below the utensil to be energized by a power source, each thermal cell being individually used for the determination; and applying a power current source and a signal source at the same time to different thermal cells, wherein each thermal cell is energized with a polarity opposite to the polarity of the current used to perform the determination of the location of the cooking utensil.

6. The method according to claim 5, wherein the signal source is a radio-frequency source.

7. The method according to claim 6, wherein the signal source has a superimposed d.c. offset with selectable polarity.

* * * * *